United States Patent [19]

Takahashi et al.

[11] 4,089,182

[45] May 16, 1978

[54] EQUIPMENT FOR REMOTELY OPERATING SELF-ADVANCING SUPPORTS USED AT THE PIT FACE IN A COAL MINE

[75] Inventors: Ken Takahashi; Hideo Inoue, both of Tokyo, Japan

[73] Assignee: Taiheiyo Engineering Inc., Tokyo, Japan

[21] Appl. No.: 750,752

[22] Filed: Dec. 15, 1976

[30] Foreign Application Priority Data

Jul. 31, 1976 Japan ..... 51-91488

[51] Int. Cl.[2] ..... E21D 15/44

[52] U.S. Cl. ..... 61/45 D; 91/170 MP

[58] Field of Search ..... 61/45 D; 91/170 MP, 91/1

[56] References Cited

U.S. PATENT DOCUMENTS

| | | | |
|---|---|---|---|
| 3,259,024 | 7/1966 | Kibble et al. | 61/45 D X |
| 3,285,015 | 11/1966 | Carnegie et al. | 61/45 D |
| 3,672,176 | 6/1972 | Groetschel | 61/45 D |

FOREIGN PATENT DOCUMENTS

| | | | |
|---|---|---|---|
| 1,121,542 | 7/1968 | United Kingdom | 91/170 MP |

*Primary Examiner*—Jacob Shapiro

*Attorney, Agent, or Firm*—Frank J. Jordan

[57] ABSTRACT

Equipment for remotely operating by transmitted signals self-advancing supports which are used with a shearer at a long-walled pit face in a coal mine comprises electromagnetic valves, one of which is connected to a hydraulic cylinder for lowering the roof plate of a self-advancing support and moving the support toward the pit face and the other of which is connected to another hydraulic cylinder for lifting the roof plate of the support, a signal converter and a receiver are connected through a cable to the electromagnetic valves including those of the other self-advancing supports in such a manner that each of the electromagnetic valves is specified through the matrix circuit system; and a portable transmitter is provided for transmitting operation signals to the receiver through the radio system.

10 Claims, 2 Drawing Figures

EQUIPMENT FOR REMOTELY OPERATING SELF-ADVANCING SUPPORTS USED AT THE PIT FACE IN A COAL MINE

The present invention relates to equipment for remotely operating self-advancing supports which are used with the ranging drum shearer at a long-walled pit face in a coal mine to support the roof of the pit face.

Each of the self-advancing supports comprising a group thereof has been conventionally operated directly by an operator, who watches and operates the self-advancing support according to the movement of the shearer. Therefore, it has been a must for him to be always near the self-advancing support to be operated, thus resulting in impairment of his health because of inspiration of dust and to be always in danger of being hurt by falling rocks due to an accident.

Further, when the pit face is narrow, he has been forced to assume an extremely difficult posture so as to operate the self-advancing support directly, thus causing the operation efficiency to be lowered.

The present invention is intended to eliminate the above-mentioned drawbacks.

It is, therefore, an object of the present invention to provide equipment for remotely operating the self-advancing supports, which makes it possible to operate the supports from a desired position remote from the supports to be operated.

Another object of the present invention is to provide equipment for remotely and safely operating self-advancing supports.

These and other objects as well as the merits of the present invention will be apparent from the following detailed description with reference to the accompanying drawing.

The drawing shows an embodiment of the present invention, in which

Figure 1:
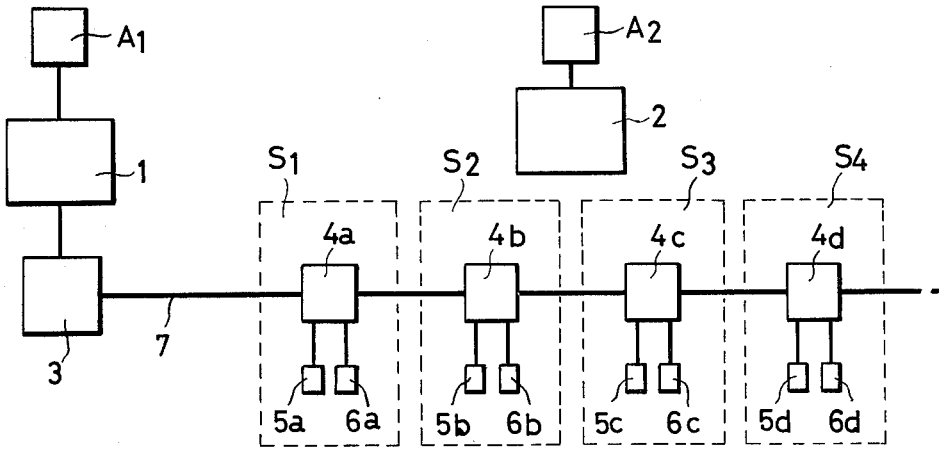
FIG. 1 is a block diagram showing one embodiment.

In FIG. 1, numeral 1 represents a receiver which after receiving through its antenna A1 the signals transmitted from an antenna A2 of a portable transmitter 2, amplifies and then applies the signals through a signal converter 3 to each of self-advancing supports S1–S4. Numerals **4*a*–4*d* denote couplers, 5*a*–5*d* and 6*a*–6*d* electromagnetic valves, and 7** a cable.

Generally speaking, each of the self-advancing supports S1–S4 includes at least two kinds of hydraulic cylinders, one of which serves as a support pole to support the roof plate of the self-advancing support at the pit face of a coal mine and the other of which serves as a shifter to move the self-advancing support toward the pit face. Namely, two kinds of these hydraulic cylinders enable the self-advancing support to lower its roof plate, to move toward the pit face and to lift its roof plate so as to again support the roof of the pit face. Therefore, each of the self-advancing supports also includes at least two electromagnetic valves, for example, electromagnetic valves **5*a*–5*d* being used for the hydraulic cylinders to lower the roof plate of the self-advancing supports and to move the supports toward the pit face and electromagnetic valves 6*a*–6*d*** which are used for the other hydraulic cylinders to enable the supports to lift the roof plate of the supports so as to again support the roof of the pit face.

The signal converter 3 is constructed so that each of the self-advancing supports can be differently operated through the matrix circuit system and that the number of operating wires covered in the cable 7 is made as few as possible.

Figure 2:
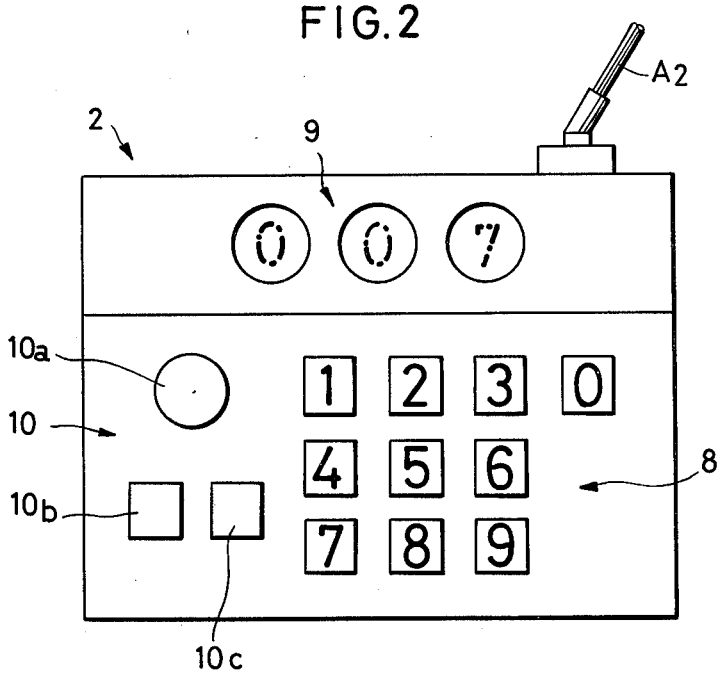
FIG. 2 is a plane view showing a portable transmitter.

FIG. 2 is a plane view showing the portable transmitter 2, in which numeral 8 represents a key board to specify the self-advancing support to be operated, 9 an indicator, and 10 an operating switch comprising a start switch **10*a*, a switch 10*b* for causing the roof plate of the self-advancing support to be lowered and the support to be moved toward the pit face, and switch 10*c* for causing the roof plate of the support to be lifted. A number is specified for each of the self-advancing supports, respectively, and when a specified self-advancing support is to be operated, the key of the key board 8 is pushed according to the number specified to the self-advancing support to be operated, acknowledging the number indicated by the indicator 9. Thus, the frequency transmitted from the transmitter is specified and when the start switch 10*a* is put ON after putting ON the switch 10*b* or 10*c*, the self-advancing support is caused to lower its roof plate and to move toward the pit face or to lift its roof plate. And when the start switch 10*a* is put OFF, the operation of the support is finished. Since the embodiment of the present invention has the matrix circuit system incorporated therein, the kinds the of the frequencies used to render the electromagnetic valves operative can be made fewer with the result that the number of the operating wires covered in the cable 7** can also be made fewer and that any wrong operation of the self-advancing supports due to the wrong connection of the operating wires can be reduced to the greatest extent.

Except for the embodiment as described above, the present invention includes the following variations.

1. The embodiment in which the antenna A1 is long and arranged parallel to the group of the self-advancing supports.

2. The embodiment in which transmission from the transmitter to the receiver is achieved through electromagnetic waves.

3. The embodiment in which transmission from the transmitter to the receiver is achieved through the inductive radio.

4. The embodiment in which a special device is needed to operate the key board and the switch provided in the portable transmitter. This embodiment is intended to reduce any wrong operation of the self-advancing supports to the greatest extent. For example, usual change-over switches are not used as the switches **10*a*–10*c***, but magnets having particular shapes such as triangular or hexagonal in section are used to render the contacts ON or OFF. Or using the electromotive force of piezo-elements, keys having the above-mentioned shapes are used to render the piezo-elements operative.

The present invention as described above enables the operator to operate the group of the self-advancing supports from a desired position remote from the supports with the result that he is protected to keep his health and his safety is secured against falling rocks due to an accident, and that he can easily operate the self-advancing supports even in a narrow space in which the direct conventional operation of the self-advancing supports was impossible.

What is claimed is:

1. Apparatus for operating self-advancing mine roof supporting systems which includes a plurality of support plate means each operated by hydraulic cylinder means for vertically moving and advancing the support plate means, the combination comprising a plurality of electromagnetic valves controlling the operation of said hydraulic cylinder means, a signal converter receiver operable to receive signals transmitted from a remote portable transmitter, and interconnecting means interconnecting said electromagnetic valves and said signal converter receiver such that the electromagnetic valves are remotely operated by said portable transmitter which transmits signals to said signal converter receiver which in turn effects operation of said electromagnetic valves through said interconnecting means.

2. Apparatus according to claim 1, wherein said signal converter receiver has an antenna which is disposed parallel to the direction advancement of the support plate means.

3. Apparatus according to claim 1, wherein the signals transmitted by said remote portable transmitter are electromagnetic waves.

4. Apparatus according to claim 1, wherein the signals transmitted by said remote portable transmitter are radio signals.

5. Apparatus according to claim 1, wherein said signal converter receiver has an antenna to pick up the signals transmitted from said remote portable transmitter.

6. Apparatus according to claim 1, wherein said interconnecting means comprises couplers and cable means interconnecting said couplers, said cable means being connected to said signal converter receiver.

7. Apparatus according to claim 1, wherein said hydraulic cylinder means for operating each support plate means comprises two hydraulic cylinders, one hydraulic cylinder for lowering and advancing the support plate means and the other hydraulic cylinder for raising the support plate means, said plurality of electromagnetic valves comprising two electromagnetic valves for operating each support plate, one for operating each of said hydraulic cylinders.

8. Apparatus according to claim 7, wherein said signal converter receiver has a keyboard means for selecting a particular support plate means to be operated, said signal converter receiver also having an indicator to indicate the selected support plate means.

9. Apparatus according to claim 7, wherein said signal converter receiver has an ON-OFF switch, a lowering-advance switch for causing each of said support plate means to be lowered and advanced, and a raising switch for causing said support plate means to be lifted.

10. Apparatus according to claim 9, wherein each of said switches are operable by operating keys, said signal converter receiver means having key-receiving means of different geometrical configurations such that each key-receiving means is operable by an operating key of a corresponding geometrical configuration.

* * * * *